US011489247B2

(12) United States Patent
Zhou et al.

(10) Patent No.: US 11,489,247 B2
(45) Date of Patent: Nov. 1, 2022

(54) INTEGRATED CIRCUIT AND TERMINAL DEVICE

(71) Applicant: HUAWEI TECHNOLOGIES CO., LTD., Guangdong (CN)

(72) Inventors: Weixi Zhou, Shanghai (CN); Ming Chang, Shanghai (CN); Hailin Dong, Shanghai (CN); Liangsheng Liu, Shenzhen (CN); Hongcheng Yin, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 119 days.

(21) Appl. No.: 17/150,365

(22) Filed: Jan. 15, 2021

(65) Prior Publication Data

US 2021/0135334 A1 May 6, 2021

Related U.S. Application Data

(63) Continuation of application No. PCT/CN2018/096010, filed on Jul. 17, 2018.

(51) Int. Cl.
*H01Q 1/22* (2006.01)
*H01Q 5/35* (2015.01)
(Continued)

(52) U.S. Cl.
CPC ..... *H01Q 1/2283* (2013.01); *H01Q 1/243* (2013.01); *H01Q 1/48* (2013.01); *H01Q 5/35* (2015.01); *H01Q 9/0414* (2013.01)

(58) Field of Classification Search
CPC ..... H01Q 1/22; H01Q 5/35; H01Q 1/24; H01Q 1/48; H01Q 9/04
(Continued)

(56) References Cited

U.S. PATENT DOCUMENTS

2009/0195477 A1 8/2009 Thiam et al.
2012/0212384 A1* 8/2012 Kam ..... H01Q 1/2283 343/834
2013/0207274 A1 8/2013 Liu et al.
(Continued)

FOREIGN PATENT DOCUMENTS

CN 102117964 A 7/2011
CN 202817197 U 3/2013
(Continued)

OTHER PUBLICATIONS

Office Action issued in Chinese Application No. 201880091939.X dated Jan. 7, 2022, 11 pages.
(Continued)

*Primary Examiner* — Andrea Lindgren Baltzell
(74) *Attorney, Agent, or Firm* — Fish & Richardson P.C.

(57) ABSTRACT

Embodiments of this application disclose an integrated circuit and a terminal device, to resolve a problem that an existing dual-band antenna has a relatively small low-frequency band range and is difficult to meet use requirements. An antenna includes a bearer structure, a first radiation patch, a second radiation patch, and a radio frequency processing chip. The first radiation patch, the second radiation patch, and the radio frequency processing chip are separately placed on different layers of the bearer structure. A first feed line and a second feed line are disposed in the bearer structure. The radio frequency processing chip feeds the first radiation patch by using the first feed line. The radio frequency processing chip feeds the second radiation patch by using the second feed line.

24 Claims, 14 Drawing Sheets

(51) Int. Cl.
*H01Q 1/24* (2006.01)
*H01Q 1/48* (2006.01)
*H01Q 9/04* (2006.01)

(58) Field of Classification Search
USPC ..... 343/848
See application file for complete search history.

(56) References Cited

U.S. PATENT DOCUMENTS

2015/0340765 A1 11/2015 Dang et al.
2016/0172761 A1* 6/2016 Garcia ..... G06K 19/077
343/700 MS

FOREIGN PATENT DOCUMENTS

| | | | |
|---|---|---|---|
| CN | 103367890 | A | 10/2013 |
| CN | 105470661 | A | 4/2016 |
| CN | 106785393 | A | 5/2017 |
| CN | 106898871 | A | 6/2017 |
| CN | 206332180 | U | 7/2017 |
| JP | H10190347 | A | 7/1998 |

OTHER PUBLICATIONS

Xinde, "Practical Antenna Engineering Technology," Xidian University Press, Jan. 2015, pp. 486-487 (with English abstract).
Baiqiang, "Chapter 3.4 Design of Multi-Resonance Broadband Stacked Coupled Microstrip Antennas in Practical Design Techniques of Modern Antennas," Xiamen University Press, 6 pages (with English translation for the related section).
Extended European Search Report issued in European Application No. 18927132.3 dated Jun. 14, 2021, 10 pages.
Gu et al., "A compact 4-chip package with 64 embedded dual-polarization antennas for W-band phased-array transceivers," 2014 IEEE 64th Electronic Components and Technology Conference (ECTC), IEEE, May 27, 2014, 6 pages.
Office Action issued in Chinese Application No. 201880091939.X dated Dec. 31, 2020, 24 pages (with English translation).
Office Action issued in Chinese Application No. 201880091939.X dated Jun. 9, 2021, 11 pages.
PCT International Search Report and Written Opinion issued in International Application No. PCT/CN2018/096010 dated Dec. 24, 2018, 16 pages (with English translation).

* cited by examiner

Side view

Top view

Low-frequency gain

High-frequency gain

INTEGRATED CIRCUIT AND TERMINAL DEVICE

CROSS-REFERENCE TO RELATED APPLICATIONS

This application is a continuation of International Application No. PCT/CN2018/096010, filed on Jul. 17, 2018, the disclosure of which is hereby incorporated by reference in its entirety.

TECHNICAL FIELD

This application relates to the field of mobile communications technologies, and in particular, to an integrated circuit and a terminal device.

BACKGROUND

As communications technologies develop, a communications system has increasingly high requirements on a bandwidth, a latency, a transmission path loss, and the like, and therefore an antenna in package (AIP) emerges. Compared with an existing patch antenna, the antenna in package has characteristics of a very short feed path, high integration, a small size, high machining precision, and the like, so that the antenna in package can obtain good electrical performance and can be easily integrated into a terminal device.

For example, in a 3G system or a 4G system, the patch antenna is usually used in a smartphone. However, in a 5G communications system, the antenna in package is usually used to implement beamforming (beamforming). An amplitude phase ratio of each antenna in package (namely, an array element) in an antenna array is adjusted, to implement beam scanning in different directions.

A package structure of a millimeter wave antenna that can implement dual-band communication may be shown in FIG. 1. In an antenna in package shown in FIG. 1, a high-frequency radiation patch is directly fed by using a feed point, to generate a high-frequency frequency response. A low-frequency radiation patch is coupled to the high-frequency radiation patch, to generate a low-frequency frequency response. Therefore, dual-band operation is implemented.

In the antenna in package shown in FIG. 1, the two radiation patches need to be coupled to implement the low-frequency frequency response. In a specific implementation, a size of the high-frequency radiation patch can be determined after a high-frequency band in which the antenna in package operates is determined. In addition, a change range of spacing between the two radiation patches is fixed based on a package requirement of the antenna. When both the size of the high-frequency radiation patch and the change range of the spacing between the two radiation patches are fixed, a coupling degree between the two radiation patches is a determined value in a specific change range. As a result, a frequency band of the low-frequency frequency response can change only in a relatively fixed range. In other words, the antenna in package shown in FIG. 1 can use a relatively small low-frequency band range, and is difficult to meet different use requirements.

In conclusion, the antenna in package, in the prior art, for implementing the dual-band communication has a relatively small low-frequency band range and is difficult to meet the use requirements.

SUMMARY

Embodiments of this application provide an integrated circuit and a terminal device, to resolve a problem that an existing dual-band antenna has a relatively small low-frequency band range and is difficult to meet use requirements.

According to a first aspect, an embodiment of this application provides an integrated circuit applied to a terminal device. The integrated circuit includes a bearer structure, a first radiation patch, a second radiation patch, and a radio frequency processing chip. The first radiation patch, the second radiation patch, and the radio frequency processing chip are separately placed on different layers of the bearer structure. A first feed line and a second feed line are disposed in the bearer structure. The radio frequency processing chip feeds the first radiation patch by using the first feed line. The radio frequency processing chip feeds the second radiation patch by using the second feed line.

The integrated circuit may be considered as an AIP integrated circuit. The antenna in package integrated circuit has characteristics of a very short feed path, high integration, a small size, high machining precision, and the like, so that an antenna in package can obtain better electrical performance. In addition, the antenna in package integrated circuit may be widely applied to a 5G communications system and a future communications system. The integrated circuit may be used as an array element in an antenna array, or may be used as an independent antenna in package.

In addition, in the integrated circuit provided in the first aspect, the radio frequency processing chip may be separately connected to the first feed line and the second feed line by using solder bumps.

In the integrated circuit provided in the first aspect, the first radiation patch and the second radiation patch are placed on the different layers of the bearer structure, and may be configured respectively to receive/send different frequency band (referred to as a first frequency band and a second frequency band below) signals. Therefore, the integrated circuit can implement dual-band operation.

In addition, in the integrated circuit provided in the first aspect, the first radiation patch and the second radiation patch are separately fed by using different feed lines (namely, the first feed line and the second feed line). Therefore, a coupling degree between the first radiation patch and the second radiation patch is relatively low. A frequency range of the first frequency band corresponding to the first radiation patch and a frequency range of the second frequency band corresponding to the second radiation patch may be separately adjustable. For example, the first frequency band may be adjusted by adjusting a first size, and the second frequency band may be adjusted by adjusting the second size. For another example, when a coupled feeding manner is used, the first frequency band may be adjusted by adjusting a coupling degree between the first radiation patch and the first feed line, and the second frequency band may be adjusted by adjusting a coupling degree between the second radiation patch and the second feed line. Therefore, the integrated circuit has higher design flexibility, and the two frequency bands have higher tunable degrees, and this can meet different use requirements.

In a possible design, the first radiation patch has a first size corresponding to a first frequency band signal, and the second radiation patch has a second size corresponding to a second frequency band signal.

According to the solution, the first frequency band may be adjusted by adjusting the first size, and the second frequency band may be adjusted by adjusting the second size.

In a possible design, a first radio frequency line corresponding to the first frequency band signal and a second radio frequency line corresponding to the second frequency band signal are disposed in the radio frequency processing chip, the first feed line is connected to the first radio frequency line, and the second feed line is connected to the second radio frequency line.

Specifically, the first radiation patch is connected to the first radio frequency line by using the first feed line, to transmit the received first frequency band signal to the first radio frequency line for processing, or send, by the first radiation patch, the first frequency band signal output by the first radio frequency line. The second radiation patch is connected to the second radio frequency line by using the second feed line, to transmit the received second frequency band signal to the second radio frequency line for processing, or send, by the second radiation patch, the second frequency band signal output by the second radio frequency line.

In a possible design, the bearer structure includes a first bearer structure and a second bearer structure. The first bearer structure is configured to bear the first radiation patch. The second bearer structure is configured to bear the second radiation patch.

In addition, the bearer structure in the integrated circuit may further include a ground plane. An opening is disposed on the ground plane. The first feed line and the second feed line pass through the opening to feed the first radiation patch and the second radiation patch respectively.

Further, the first radiation patch may be located between the second radiation patch and the ground plane. According to the solution, the ground plane may be used as a reference ground of the first radiation patch. The first radiation patch may be used as a reference ground of the second radiation patch.

In addition, when the first radiation patch is located between the second radiation patch and the ground plane, a window is disposed on the first radiation patch. The second feed line passes through the window on the first radiation patch to feed the second radiation patch.

To further improve isolation between the first frequency band and the second frequency band, the integrated circuit provided in the first aspect may further include a plurality of metal columns. One end of each of the plurality of metal columns is connected to the ground plane. The other end is connected to the first radiation patch. The plurality of metal columns form encirclement around the first radiation patch. The second feed line passes through the encirclement.

The encirclement formed by the plurality of metal columns may be understood as encirclement formed by projections of the plurality of metal columns in space. In a possible implementation, that the plurality of metal columns form the encirclement around the first radiation patch is that the plurality of metal columns form the encirclement around a center (or a perpendicular line) of the first radiation patch. The first feed line is located outside the encirclement formed by the plurality of metal columns.

In addition, a shape of the encirclement formed the plurality of metal columns is not specifically limited in this embodiment of this application. For example, the encirclement may be a square, a rectangle, a circle, or the like.

According to the solution, the encirclement formed by the plurality of metal columns may be considered as a potential zero-point region of the first radiation patch. The second feed line is disposed in the encirclement formed by the plurality of metal columns. In other words, the second feed line is disposed in the potential zero-point region of the first radiation patch. Therefore, according to the solution, a feed path of the second radiation patch can be isolated from a feed path of the first radiation patch, to improve isolation between the first frequency band signal and the second frequency band signal.

In addition, when the second feed line passes through the window on the first radiation patch to feed the second radiation patch, and the second feed line passes through the window on the first radiation patch, the second frequency band signal also causes interference to the first frequency band signal. The plurality of metal columns are disposed, the window on the first radiation patch is located in the potential zero-point region of the first radiation patch, and the window no longer radiates the first frequency band signal. Therefore, the solution may reduce interference between the first frequency band signal and the second frequency band signal.

In a possible design, the first feed line may include a first vertical feed line and a first horizontal feed line. The second feed line may include a second vertical feed line and a second horizontal feed line.

Correspondingly, the first radiation patch includes two feed points that correspond to the first vertical feed line and the first horizontal feed line respectively. The second radiation patch includes two feed points that correspond to the second vertical feed line and the second horizontal feed line respectively.

Specifically, locations of the two feed points on the first radiation patch and locations of two feed points on the second radiation patch may be set as follows: A difference between polarization directions of the two feed points on the first radiation patch is 90°, a difference between polarization directions of the two feed points on the second radiation patch is 90°, and differences between polarization directions of any feed point on the first radiation patch and the two feed points on the second radiation patch are 90° and 180°.

According to the solution, the integrated circuit may generate dual-polarized radiation (in a horizontal polarization direction and a vertical polarization direction) at the first frequency band, and dual-polarized radiation (in the horizontal polarization direction and the vertical polarization direction) at the second frequency band. In other words, according to the solution, the integrated circuit can implement dual polarization. A dual-polarized antenna has a characteristic of dual-channel communication at a same frequency band. Therefore, a duplex operation can be implemented by using the dual-polarized antenna, to improve a communication capacity, improve system sensitivity, and enhance an anti-multipath effect of a system.

In addition, to further improve isolation between a first frequency band signal transmitted on the first vertical feed line and a first frequency band signal transmitted on the first horizontal feed line, a first groove may be further disposed on the first radiation patch. The first vertical feed line and the first horizontal feed line are located on two sides of the first groove respectively.

The first groove may isolate, to some extent, the first frequency band signal transmitted on the first vertical feed line and the first frequency band signal transmitted on the first horizontal feed line, to achieve an effect of improving the isolation between first frequency band signals in the two polarization directions.

Likewise, to further improve isolation between a second frequency band signal transmitted on the second vertical feed line and a second frequency band signal transmitted on the second horizontal feed line, a second groove may be further disposed on the second radiation patch. The second vertical feed line and the second horizontal feed line are located on two sides of the second groove respectively.

The second groove may isolate, to some extent, the second frequency band signal transmitted on the second vertical feed line and the second frequency band signal transmitted on the second horizontal feed line, to achieve an effect of improving the isolation between second frequency band signals in the two polarization directions.

It should be noted that shapes and sizes of the first groove and the second groove are not specifically limited in this embodiment of this application, provided that the first groove can be configured to isolate the two feed points on the first radiation patch, and the second groove can be configured to isolate the two feed points on the second radiation patch. For example, both the first groove and the second groove may be T-shaped grooves.

In a possible design, the first radiation patch and the second radiation patch are parallel to each other, and a center of the first radiation patch is aligned with a center of the second radiation patch.

That the center of the first radiation patch is aligned with the center of the second radiation patch may be understood as that a connection line between the center of the first radiation patch and the center of the second radiation patch is approximately perpendicular to the first radiation patch. When the first radiation patch and the second radiation patch are parallel, and the center of the first radiation patch is aligned with the center of the second radiation patch, a pattern in which relative field strength of a radiation field at a specific distance from the integrated circuit changes with a direction is symmetric. In other words, a direction pattern of the integrated circuit is symmetric. Therefore, the integrated circuit can obtain relatively good performance.

In a possible design, the first radiation patch is divided into a first part and a second part, and the first part of the first radiation patch and the second part of the first radiation patch are connected by using a tunable capacitor or a switch unit.

According to the solution, a capacitance value of the tunable capacitor is adjusted or connection disconnection of the switch unit is controlled, to adjust a frequency range of the first frequency band.

Likewise, the second radiation patch is also divided into a first part and a second part, and the first part of the second radiation patch and the second part of the second radiation patch are connected by using a tunable capacitor or a switch unit.

In addition, a specific structure, material, and the like of the bearer structure are not limited in this embodiment of this application. For example, the bearer structure may include stacked dielectric layers, a dielectric layer and a metal layer that are alternately stacked, a dielectric layer and a metal ball structure that are alternately stacked, a dielectric layer and a metal column structure that are alternately stacked, or a plastic ball structure and a metal layer that are alternately stacked.

Compared with that in a solution in which the bearer structure is formed only by the stacked dielectric layers, two materials (for example, a metal material and a dielectric material, and a metal material and a plastic material) are alternately stacked to form the bearer structure. Although a package process is more complex, the integrated circuit provided in the first aspect can have relatively good electrical performance.

The metal ball structure may include a plurality of metal balls. The metal column structure may include a plurality of metal columns. The plastic ball structure may include a plurality of plastic balls.

A material of the dielectric layer includes but is not limited to organic resin, polytetrafluoroethylene, and a polytetrafluoroethylene composite material including a fiberglass cloth. A material of the metal layer includes but is not limited to copper and tin. A material of the metal column structure includes but is not limited to copper and tin. A material of the metal ball structure includes but is not limited to copper and tin.

According to a second aspect, an embodiment of this application provides a terminal device. The terminal device includes the integrated circuit provided in any one of the first aspect or the possible designs of the first aspect.

In a possible design, the terminal device provided in the second aspect may further include a printed circuit board PCB, and the bearer structure in the integrated circuit is connected to the PCB by using a ball grid array BGA.

Specifically, the terminal device includes but is not limited to a smartphone, a smartwatch, a tablet computer, a virtual reality (virtual reality, VR) device, an augmented reality (augmented reality, AR) device, a personal computer, a handheld computer, and a personal digital assistant.

DESCRIPTION OF EMBODIMENTS

Embodiments of this application provide an integrated circuit and a terminal device, to resolve a problem that an existing dual-band antenna has a relatively small low-frequency band range and is difficult to meet use requirements.

To make the objectives, technical solutions, and advantages of this application clearer, the following further describes this application in detail with reference to the accompanying drawings. It should be noted that "a plurality of" in this application refers to two or more than two. In addition, it should be understood that in descriptions of this application, terms such as "first" and "second" are merely used for differentiation and description, but should not be understood as an indication or implication of relative importance, or an indication or implication of an order.

Figure 1:
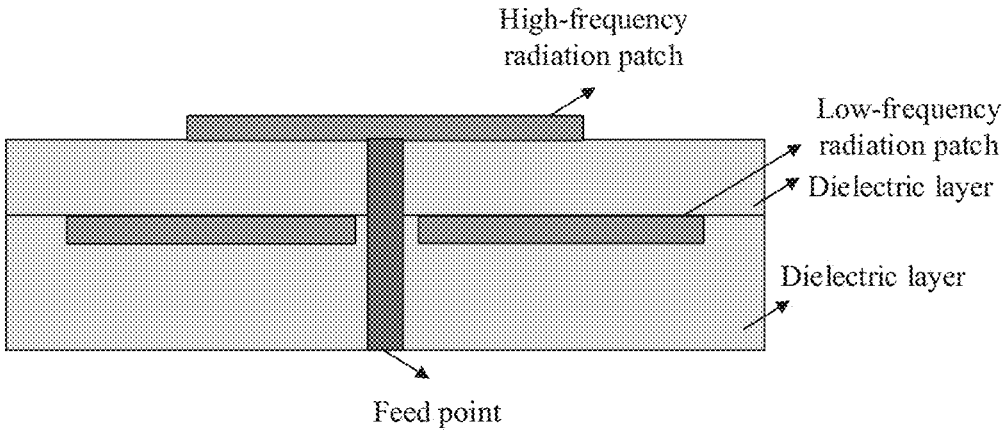
FIG. 1 is a schematic diagram of a structure of a dual-band antenna according to the prior art.
Figure 2:
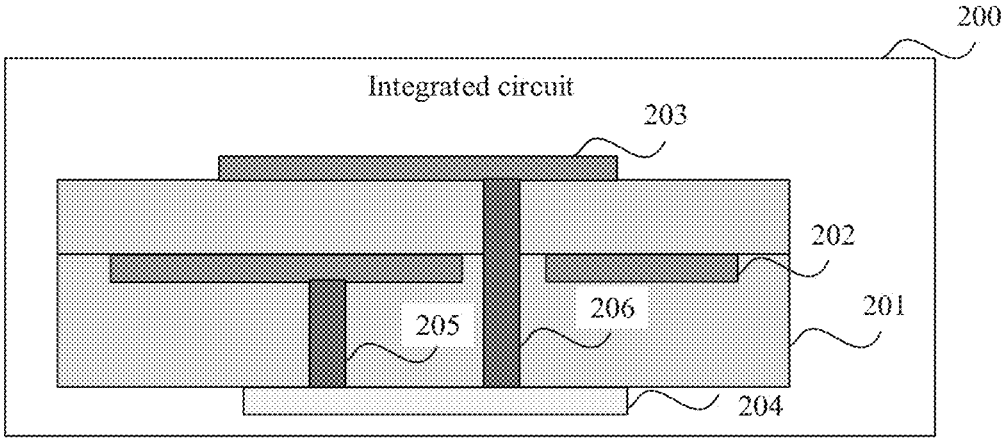
FIG. 2 is a schematic diagram of a structure of a first integrated circuit according to an embodiment of this application.

FIG. 2 shows an integrated circuit according to an embodiment of this application. The integrated circuit may be considered as an antenna in package (namely, AIP) integrated circuit applied to a terminal device. The integrated circuit may be used as an array element in an antenna array, or may be used as an independent antenna in package.

A standard used by the terminal device includes but is not limited to code division multiple access (code division multiple access, CDMA), wideband code division multiple access (WCDMA), time division-synchronous code division multiple access (TD-SCDMA), long term evolution (LTE), and a 5th generation (5G) standard.

The integrated circuit 200 includes a bearer structure 201, a first radiation patch 202, a second radiation patch 203, and a radio frequency processing chip 204. The first radiation patch 202, the second radiation patch 203, and the radio frequency processing chip 204 are separately placed on different layers of the bearer structure 201. A first feed line 205 and a second feed line 206 are disposed in the bearer structure 201. The radio frequency processing chip 204 feeds the first radiation patch 202 by using the first feed line 205. The radio frequency processing chip 204 feeds the second radiation patch 203 by using the second feed line 206. Specifically, in the integrated circuit 200, the bearer structure 201 may include a first bearer structure and a second bearer structure. The first bearer structure is configured to bear the first radiation patch 202. The second bearer structure is configured to bear the second radiation patch 203.

In the integrated circuit 200, the first radiation patch 202 and the second radiation patch 203 are placed on the different layers of the bearer structure 201, and may be configured respectively to receive/send different frequency band (referred to as a first frequency band and a second frequency band below) signals. Therefore, the integrated circuit 200 is used as an antenna in package and can implement dual-band operation.

Both the first frequency band and the second frequency band may be millimeter-wave bands in the 5G standard.

Optionally, in the integrated circuit 200, the first radiation patch 202 has a first size corresponding to a first frequency band signal, and the second radiation patch 203 has a second size corresponding to a second frequency band signal. In other words, the first radiation patch 202 may be configured to receive/send the first frequency band signal, and the second radiation patch 203 may be configured to receive/send the second frequency band signal. Therefore, the integrated circuit 200 may operate in two frequency bands; the first frequency band and the second frequency band, to implement the dual-band operation.

In addition, because the first radiation patch 202 and the second radiation patch 203 are separately fed by using different feed lines (namely, the first feed line 205 and the second feed line 206), a coupling degree between the first radiation patch 202 and the second radiation patch 203 is relatively low. In actual application, the first frequency band may be adjusted by adjusting the first size, or the second frequency band may be adjusted by adjusting the second size. In other words, the first frequency band and the second frequency band each are adjustable. Therefore, the integrated circuit 200 has relatively high design flexibility. In the integrated circuit 200, usually, a frequency band corresponding to a radiation patch located at an upper layer is relatively high, and a frequency band corresponding to a radiation patch located at a lower layer is relatively low, to reduce interference between the two radiation patches. In other words, in an example in FIG. 2, the first frequency band is a low-frequency band, and the second frequency band is a high-frequency band. For example, the first frequency band may correspond to a 28 GHz frequency band, and the second frequency band may correspond to a 39 GHz frequency band.

Specifically, when the integrated circuit 200 implements the dual-band operation, a first radio frequency line corresponding to the first frequency band signal and a second radio frequency line corresponding to the second frequency band signal are disposed in the radio frequency processing chip 204. The first feed line 205 is connected to the first radio frequency line. The second feed line 206 is connected to the second radio frequency line.

When receiving/sending the first frequency band signal, the first radiation patch 202 may be connected to the first radio frequency line of the radio frequency processing chip 204 by using the first feed line 205, to transmit the received first frequency band signal to the radio frequency processing chip 204 for processing, or send out, by the first radiation patch 202, the first frequency band signal output by the radio frequency processing chip 204. When receiving/sending the second frequency band signal, the second radiation patch 203 may be connected to the second radio frequency line of the radio frequency processing chip 204 by using the second feed line 206, to transmit the received second frequency band signal to the radio frequency processing chip 204 for processing, or send out, by the second radiation patch 203, the second frequency band signal output by the radio frequency processing chip 204.

A process in which the radio frequency processing chip 204 processes the first frequency band signal is similar to a process in which the radio frequency processing chip 204 processes the second frequency band signal. The following uses the process of processing the first band signal as an example to describe a processing process of the radio frequency processing chip 204.

In a process of sending the first frequency band signal, after the radio frequency processing chip 204 receives an intermediate frequency signal transmitted by an upper-level chip (for example, an intermediate frequency chip), a frequency mixer in the first radio frequency line performs frequency mixing on the intermediate frequency signal. Then, a phase shifter performs phase shifting on the mixed signal to implement beamforming. After the signal output by the phase shifter is amplified by an amplifier, the signal output by the amplifier is used as a final output radio frequency signal of the first frequency band. The radio frequency signal is transmitted to the first radiation patch 202 by using the first feed line 205 and sent out.

In a process of receiving the first frequency band signal, after receiving the radio frequency signal of the first frequency band signal, the first radiation patch 202 may transmit the radio frequency signal to the first radio frequency line in the radio frequency processing chip 204 by using the first feed line 205. The first radio frequency line may include the amplifier, the phase shifter, and the frequency mixer. The amplifier amplifies the radio frequency signal, and then the phase shifter performs the phase shifting operation on the amplified signal. After the frequency mixer performs the frequency mixing on the signal output by the phase shifter, the first radio frequency line uses the signal output by the frequency mixer as the final output intermediate frequency signal, and transmits the intermediate frequency signal to a lower-level chip (for example, an intermediate frequency chip). Certainly, the foregoing processing process is merely an example. In a specific implementation, the processing process of the radio frequency processing chip 204 may further include operations such as filtering, analog-to-digital conversion, and digital-to-analog conversion. For these operations, refer to descriptions in the prior art. Details are not described in this embodiment of this application.

Figure 3:
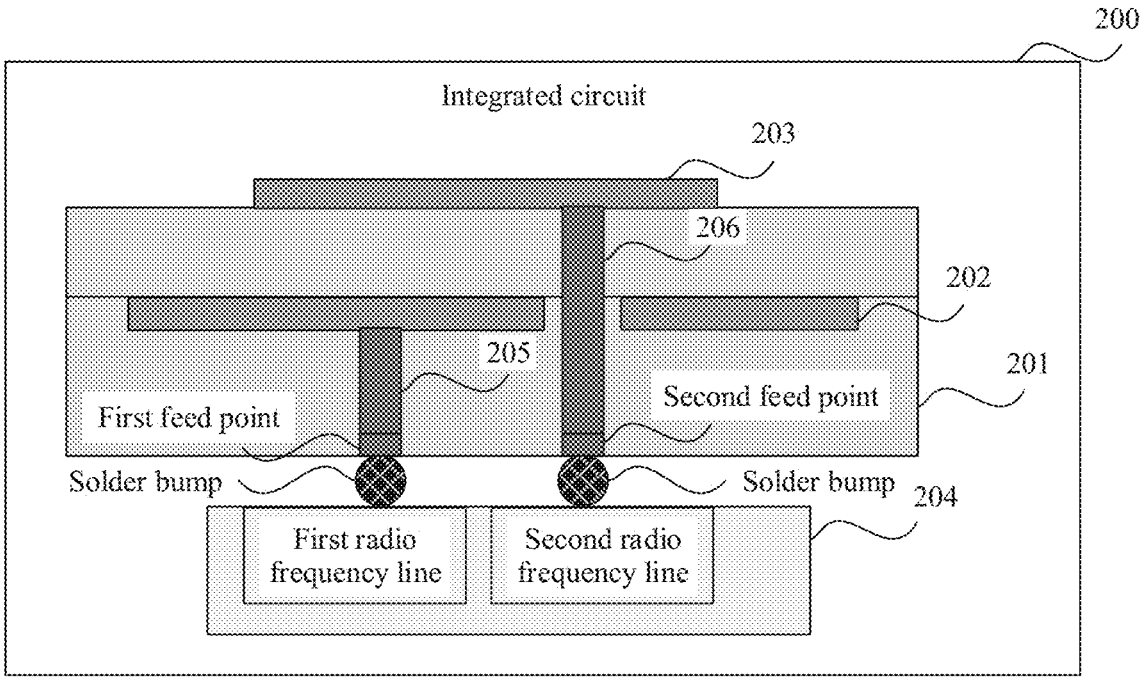
FIG. 3 is a schematic diagram in which a first feed line and a second feed line are connected to a radio frequency processing chip according to an embodiment of this application.

In a specific implementation, the first feed line 205 and the second feed line 206 may be separately connected to the radio frequency processing chip 204 by using solder bumps (solder bump). For example, the first feed line 205 may be connected, by using a solder bump, to the first radio frequency line corresponding to the first frequency band signal. The second feed line 206 may be connected, by using a solder bump, to the second radio frequency line corresponding to the second frequency band signal. For example, a schematic diagram in which the first feed line 205 and the second feed line 206 are connected to the radio frequency processing chip 204 may be shown in FIG. 3.

A joint between the first feed line 205 and the solder bump may be referred to as a first feed point or a first feedpoint. The first radiation patch 202 obtains a signal from the first feed point. A joint between the second feed line 206 and the solder hump may be referred to as a second feed point or a second feedpoint. The second radiation patch 203 obtains a signal from the second feed point.

Figure 4:
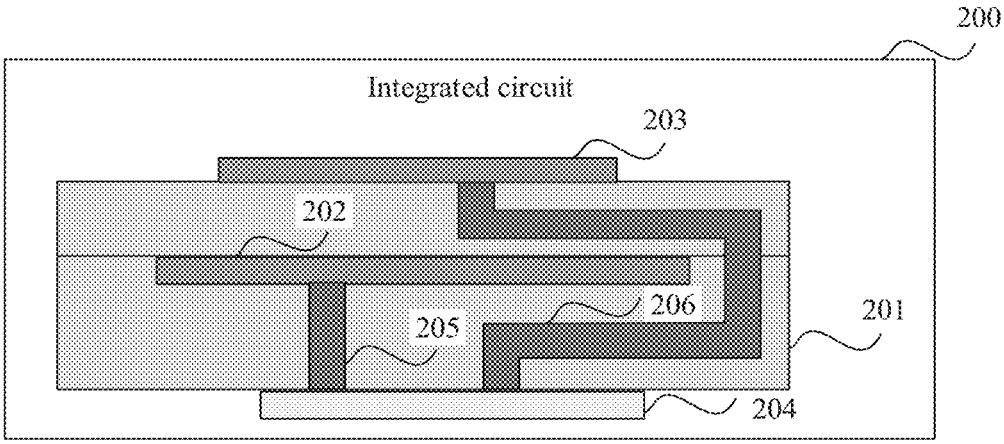
FIG. 4 is a schematic diagram of a structure of a second integrated circuit according to an embodiment of this application.

It should be noted that, in the integrated circuit 200 shown in FIG. 2, the first radiation patch 202 is placed below the second radiation patch 203. In an actual implementation, the first radiation patch 202 may alternatively be placed above the second radiation patch 203. A stacking sequence of the first radiation patch 202 and the second radiation patch 203 is not specifically limited in this embodiment of this application. In addition, in the integrated circuit 200 shown in FIG. 2, a window may be disposed on the first radiation patch 202. The second feed line 206 passes through the window on the first radiation patch 202 to feed the second radiation patch 203. In an actual implementation, there may be no window disposed on the first radiation patch 202. The second feed line 206 may bypass the first radiation patch 202 to feed the second radiation patch 203, as shown in FIG. 4. For ease of illustration, in this embodiment of this application, a manner in which the second feed line 206 passes through the window on the first radiation patch 202 to feed the second radiation patch 203 is used as an example, and the feeding manner shown in FIG. 4 is not specifically described.

In the integrated circuit 200 shown in FIG. 2, the first radiation patch 202 is fed by using the first feed line 205. The second radiation patch 203 is fed by using the second feed line 206. Specifically, the first feed line 205 may feed the first radiation patch 202 in a direct feeding manner, or may feed the first radiation patch 202 in a coupled feeding manner. When the direct feeding manner is used, the first feed line 205 is directly connected to the first radiation patch 202, as shown in FIG. 2. When the coupled feeding manner is used, the first feed line 205 is coupled to the first radiation patch 202. Likewise, the second feed line 206 may feed the second radiation patch 203 in a direct feeding manner, or may feed the second radiation patch 203 in a coupled feeding manner. When the direct feeding manner is used, the second feed line 206 is directly connected to the second radiation patch 203, as shown in FIG. 2. When the coupled feeding manner is used, the second feed line 206 is coupled to the second radiation patch 203.

It should be noted that, in FIG. 2, both the first radiation patch 202 and the second radiation patch 203 in the integrated circuit 200 are shown in the direct feeding manner. In an actual implementation, both the first radiation patch 202 and the second radiation patch 203 may be fed in either of the two feeding manners. For example, when both the first radiation patch 202 and the second radiation patch 203 use the coupled feeding manner, a schematic diagram of a structure of the integrated circuit 200 may be shown in FIG. 5.

Figure 5:
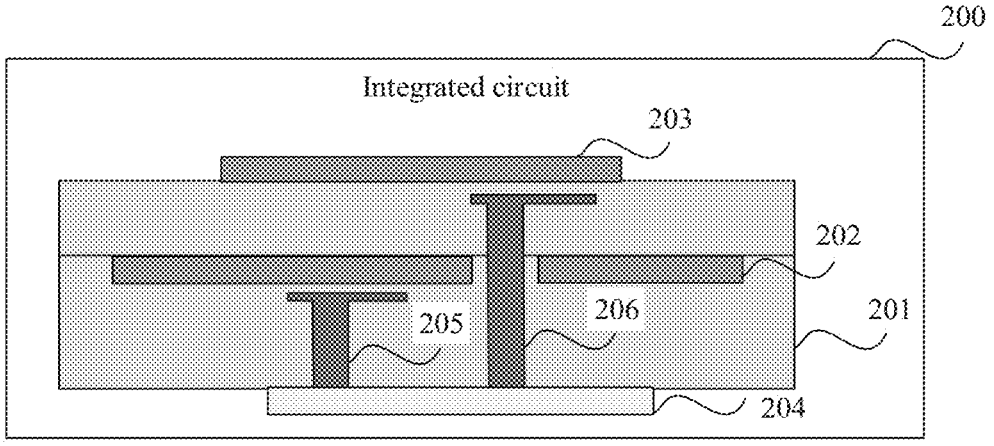
FIG. 5 is a schematic diagram of a structure of a third integrated circuit according to an embodiment of this application.

In FIG. 5, the first feed line 205 is not directly connected to the first radiation patch 202. One end that is of the first feed line 205 and that is away from the first feed point extends to a platform. The platform and the first radiation patch 202 may form resonance, to feed the first radiation patch 202 by using the first feed line 205. Likewise, the second feed line 206 is not directly connected to the second radiation patch 203. One end that is of the second feed line 206 and that is away from the second feed point extends to a platform. The platform and the second radiation patch 203 may form resonance, to feed the second radiation patch 203 by using the second feed line 206.

When the coupled feeding manner is used, the first size of the first radiation patch 202 may be adjusted, to change a coupling degree between the first radiation patch 202 and the first feed line 205, and further adjust a frequency range of the first frequency band. Alternatively, parameters such as a size and a shape of the first feed line 205 may be adjusted (for example, a size and a shape of the platform that is extended by the end that is of the first feed line 205 and that is away from one end of the first feed point in FIG. 5), to adjust a coupling degree between the first radiation patch 202 and the first feed line 205, and further adjust a frequency range of the first frequency band. Likewise, when the coupled feeding manner is used, the second size of the second radiation patch 203 is adjusted, to adjust a frequency range of the second frequency band. Alternatively, parameters such as a size and a shape of the second feed line 206 are adjusted (for example, a size and a shape of the platform that is extended by the end that is of the second feed line 206 and that is away from one end of the second feed point in FIG. 5), to adjust a frequency range of the second frequency band.

Based on the foregoing two feeding manners, the direct feeding is easy to design and implement. The coupled feeding manner can reduce puncturing in the integrated circuit 200. In addition, the coupled feeding manner has a more adjustable frequency band, and improve electrical performance of the integrated circuit 200.

In addition, a specific structure, material, and the like of the bearer structure 201 are not limited in the integrated circuit 200, provided that the bearer structure 201 can have a bearing function.

The following provides several specific examples of the bearer structure in this embodiment of this application.

For example, the bearer structure 201 may include stacked dielectric layers. A material of the dielectric layer includes but is not limited to organic resin, polytetrafluoroethylene, and polytetrafluoroethylene composite material including a fiberglass cloth.

For example, the bearer structure 201 may further include a dielectric layer and a metal layer that are alternately stacked. A material of the dielectric layer includes but is not limited to organic resin, polytetrafluoroethylene, and a polytetrafluoroethylene composite material including a fiberglass cloth. A material of the metal layer includes but is not limited to copper, tin, and the like.

For example, the bearer structure 201 may further include a dielectric layer and a metal ball structure that are alternately stacked. A material of the dielectric layer includes but is not limited to organic resin, polytetrafluoroethylene, and a polytetrafluoroethylene composite material including a fiberglass cloth. A material of the metal ball structure includes but is not limited to copper, tin, and the like. In this example, the metal ball structure may be considered as a plurality of metal balls stacked on the dielectric layer. There are gaps between the plurality of metal balls sandwiched between two dielectric layers. In other words, in this example, there are the gaps in the bearer structure 201.

For example, the bearer structure 201 may further include a dielectric layer and a metal column structure that are alternately stacked. A material of the dielectric layer includes but is not limited to organic resin, polytetrafluoroethylene, and a polytetrafluoroethylene composite material including a fiberglass cloth. A material of the metal column structure includes but is not limited to copper, tin, and the like. In this example, the metal column structure may be considered as a plurality of metal columns stacked on the dielectric layer. There are gaps between the plurality of metal columns sandwiched between two dielectric layers. In other words, in this example, there are the gaps in the bearer structure 201.

For example, the bearer structure 201 may further include a plastic ball structure and a metal layer that are alternately stacked. A material of the metal layer includes but is not limited to copper, tin, and the like. In this example, the plastic ball structure may be considered as a plurality of plastic balls stacked on the metal layer. There are gaps between the plurality of plastic balls sandwiched between two metal layers. In other words, in this example, there are the gaps in the bearer structure 201.

Compared with that in a solution in which the bearer structure 201 is formed only by the stacked dielectric layers, two materials (for example, a metal material and a dielectric material, and a metal material and a plastic material) are alternately stacked to form the bearer structure 201. Although a package process is more complex, the integrated circuit 200 can have relatively good electrical performance.

In the integrated circuit 200, the first radiation patch 202 and the second radiation patch 203 are parallel to each other, and a center of the first radiation patch 202 is aligned with a center of the second radiation patch 203.

Figure 6:
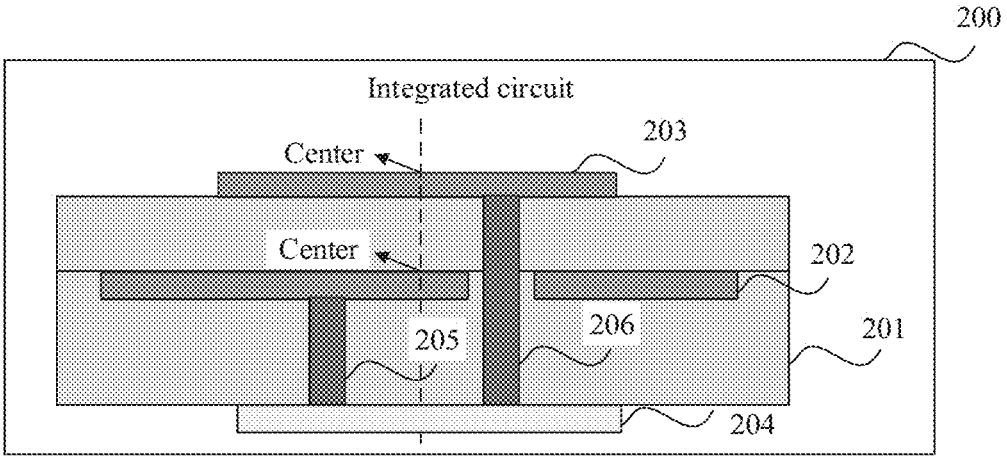
FIG. 6 is a schematic diagram of a structure of a fourth integrated circuit according to an embodiment of this application.

In this embodiment of this application, the center of the first radiation patch 202 is aligned with the center of the second radiation patch 203. In other words, a connection line between the center of the first radiation patch 202 and the center of the second radiation patch 203 is approximately perpendicular to the first radiation patch 202. When the first radiation patch 202 is parallel to the second radiation patch 203, and the center of the first radiation patch 202 is aligned with the center of the second radiation patch 203, a schematic diagram of a structure of the integrated circuit 200 may be shown in FIG. 6.

When the first radiation patch 202 and the second radiation patch 203 are parallel, and when the center of the first radiation patch 202 is aligned with the center of the second radiation patch 203, a pattern in which relative field strength of a radiation field at a specific distance from the integrated circuit 200 changes with a direction is symmetric. In other words, a direction pattern of the integrated circuit 200 is symmetric. Therefore, the integrated circuit 200 can obtain relatively good performance.

Figure 7:
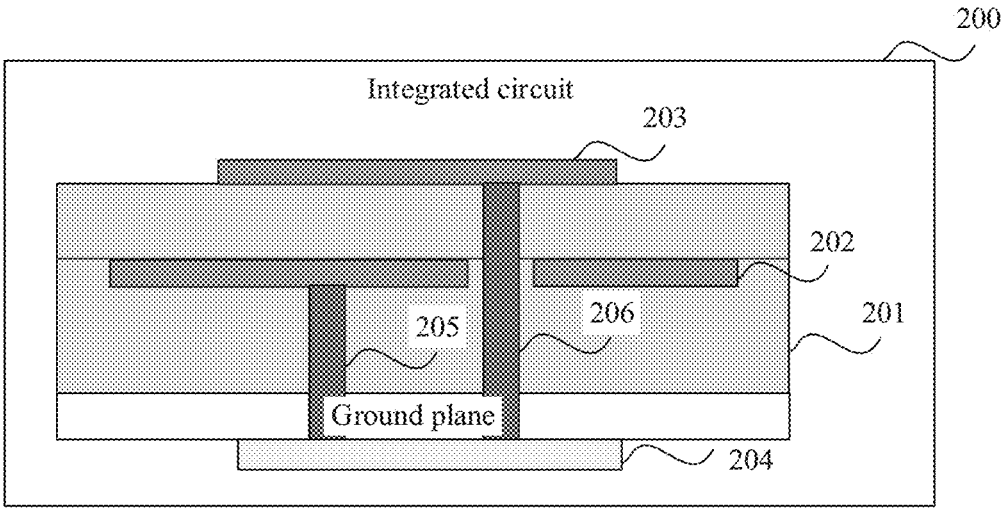
FIG. 7 is a schematic diagram of a structure of a fifth integrated circuit according to an embodiment of this application.

As described above, the bearer structure 201 may include a first bearer structure configured to bear the first radiation patch 201 and a second bearer structure configured to bear the second radiation patch 203. In addition, the bearer structure 201 may further include a ground plane. An opening is disposed on the ground plane. The first feed line 205 and the second feed line 206 pass through the opening to feed the first radiation patch 202 and the second radiation patch 203 respectively. The ground plane may be considered as a reference ground of the integrated circuit 200. The first radiation patch 202 may be located between the second radiation patch 203 and the ground plane. Based on this implementation, a schematic diagram of a structure of the integrated circuit 200 may be shown in FIG. 7.

In the implementation, the ground plane may be used as a reference ground of the first radiation patch 202. The first radiation patch 202 may be used as a reference ground of the second radiation patch 203.

To further improve isolation between a first frequency band and a second frequency band, the integrated circuit 200 in this embodiment of this application may further include a plurality of metal columns. One end of each of the plurality of metal columns is connected to the ground plane. The other end is connected to the first radiation patch 202. The plurality of metal columns form encirclement around the first radiation patch 202. The second feed line 206 passes through the encirclement.

The end of each of the plurality of metal columns is connected to the ground plane, and the other end is connected to the first radiation patch 202. In other words, each metal column is disposed in space between the first radiation patch 202 and the ground plane. The encirclement formed by the plurality of metal columns may be understood as encirclement formed by projections of the plurality of metal columns in space. In other words, that the plurality of metal columns form the encirclement around the first radiation patch 202 does not represent a real inclusion relationship (to be specific, it does not represent that the first radiation patch 202 is placed in the middle of the plurality of metal columns), but represents an inclusion relationship on a spatial projection (to be specific, it represents that the first radiation patch 202 is placed in the encirclement formed by the projections of the plurality of metal columns in the space).

In a possible implementation, the encirclement formed by the plurality of metal columns around the first radiation patch 202 may be understood as encirclement formed by the plurality of metal columns around the center (or a perpendicular line) of the first radiation patch 202. In other words, a part or all parts of the first radiation patch 202 may be disposed in the encirclement formed by the projections of the plurality of metal columns in the space. In an optional embodiment of this application, the projections of the plurality of metal columns may pass through the first radiation patch 202. That the plurality of metal columns form the encirclement around the first radiation patch 202 may be understood as that the plurality of metal columns form encirclement around the part of the first radiation patch 202.

Optionally, the first feed line 205 is located outside the encirclement formed by the plurality of metal columns.

In the implementation, the plurality of metal columns mainly have the following three functions:

1. The encirclement formed by the plurality of metal columns may be considered as a potential zero-point region of the first radiation patch 202. The second feed line 206 is disposed in the encirclement formed by the plurality of metal columns. In other words, the second feed line 206 is disposed in the potential zero-point region of the first radiation patch 202. Therefore, in the implementation, a feed path of the second radiation patch 203 can be isolated from a feed path of the first radiation patch 202, to improve isolation between the first frequency band signal and the second frequency band signal.

2. When the second feed line 206 passes through the window on the first radiation patch 202 to feed the second radiation patch 203, and the second feed line 206 passes through the window on the first radiation patch 202, the second frequency band signal also causes interference to the first frequency band signal. The plurality of metal columns are disposed, the window on the first radiation patch 202 is located in the potential zero-point region of the first radiation patch 202, and the window no longer radiates the first frequency band signal. Therefore, the solution may reduce interference between the first frequency band signal and the second frequency band signal.

3. As described above, in this implementation of this application, the ground plane may be used as the reference ground of the first radiation patch 202. The first radiation patch 202 may be used as the reference ground of the second radiation patch 203. Parameters such as a shape and a size of the ground plane may be adjusted to change beam width of the first frequency band signal. After the plurality of metal columns are disposed, parameters such as a shape and a circumference of the encirclement formed by the plurality of metal columns may be adjusted to change beam width of the second frequency band signal.

Figure 8:
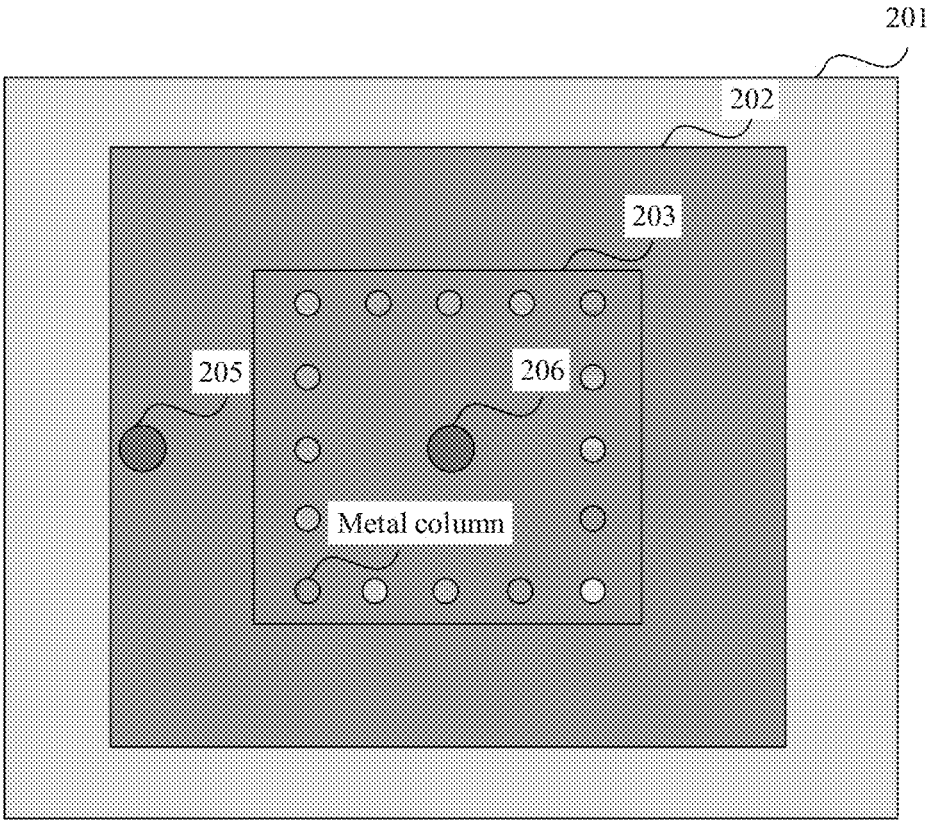
FIG. 8 is a schematic diagram of a structure of a sixth integrated circuit according to an embodiment of this application.

When the integrated circuit 200 includes a plurality of first metal columns, a top view of the integrated circuit 200 may be shown in FIG. 8. In FIG. 8, the plurality of metal columns form a square encirclement, and the second feed line 206 is located in the square encirclement.

It should be noted that, in FIG. 8, a perspective manner is used to illustrate a location relationship between the first radiation patch 202, the second radiation patch 203, the first feed line 205, and the second feed line 206. In an actual implementation, only the second radiation patch 203 and the bearer structure 201 may be seen in the top view of the integrated circuit 200. In addition, it should also be noted that, to avoid confusion, the radio frequency processing chip 204 is not shown in the perspective view of the integrated circuit 200 provided in this embodiment of this application.

It should also be noted that a shape of the encirclement formed by the plurality of metal columns is not specifically limited in this embodiment of this application. For example, the encirclement may be a square, a rectangle, a circle, or the like. In FIG. 8, only a square is used as a specific example. In an actual implementation, the shape of the encirclement is not limited to the square.

It can be learned from the foregoing description that the integrated circuit 200 can implement dual-band communication. Isolation between two frequency bands is relatively high. To further improve a system capacity, the integrated circuit 200 may be further designed as a dual-polarized antenna. In other words, the first radiation patch 202 may simultaneously receive/send first frequency band signals in two polarization directions, and the second radiation patch 203 may also simultaneously receive/send second band signals in two polarization directions.

In a specific implementation, the first feed line 205 may include a first vertical feed line and a first horizontal feed line, so that the integrated circuit 200 generates dual-polarized radiation on the first frequency band. The second feed line 206 may include a second vertical feed line and a second horizontal feed line, so that the integrated circuit 200 generates dual-polarized radiation on the second frequency band. In other words, the first feed line 205 may generate vertical polarization radiation and horizontal polarization radiation on the first frequency band. The second feed line 206 may also generate vertical polarization radiation and horizontal polarization radiation on the second frequency band.

When dual polarization is implemented in the foregoing manner, the first radiation patch 202 includes two feed points that correspond to the first vertical feed line and the first horizontal feed line respectively. The second radiation patch 203 also includes two feed points that correspond to the second vertical feed line and the second horizontal feed line respectively. Feed points corresponding to two different polarization directions of one frequency band may meet a circular polarization characteristic. In other words, in an electromagnetic field in which the first radiation patch 202 is used as a center (or the second radiation patch 203 is used as a center) and a polarization direction changes from 0 to 360°, a difference between polarization directions of the two feed points on the first radiation patch 202 is 90°, a difference between polarization directions of the two feed points on the second radiation patch 203 is 90°, and differences between polarization directions of any feed point on the first radiation patch 202 and the two feed points on the second radiation patch 203 are 90° and 180°.

Figure 9:
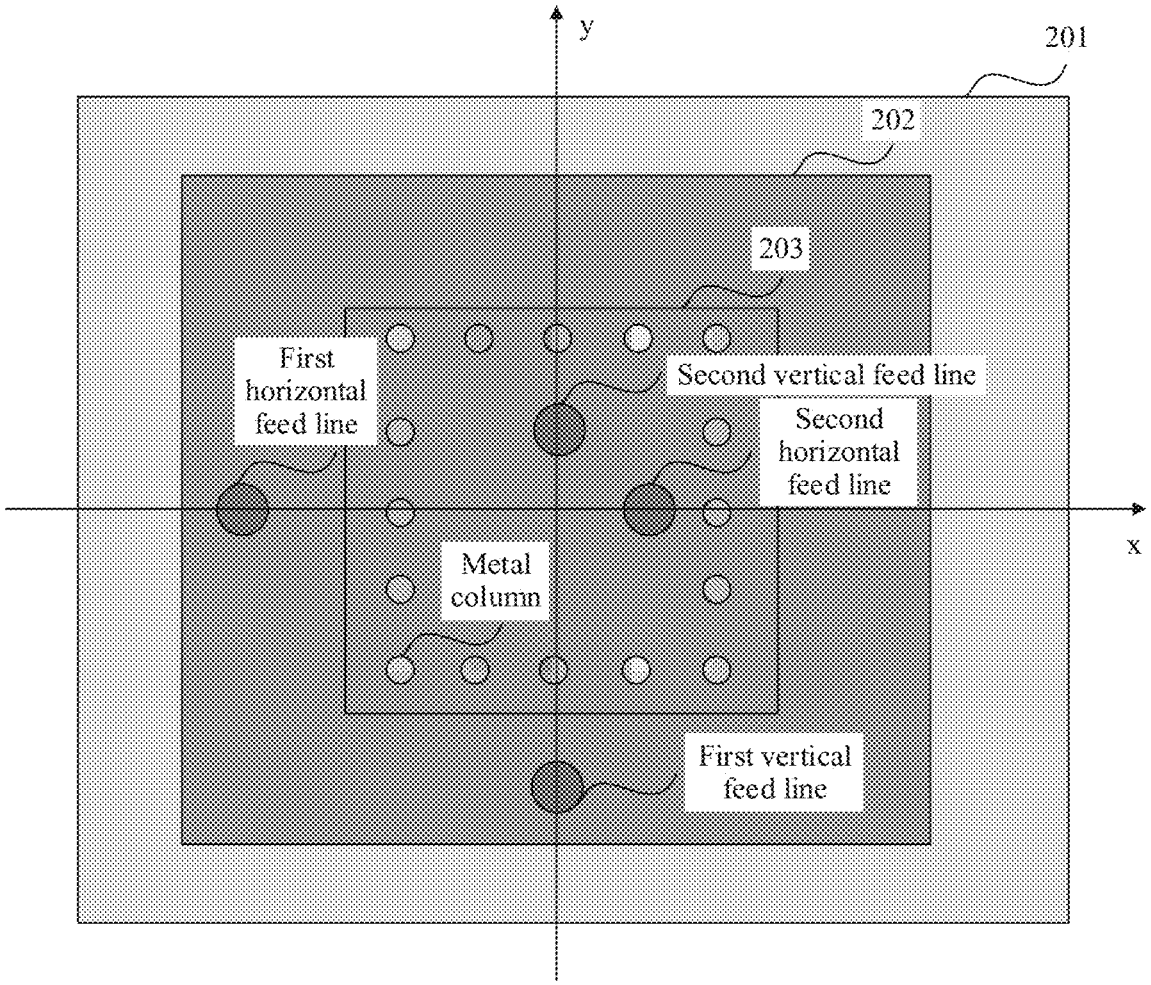
FIG. 9 is a schematic diagram of a structure of a seventh integrated circuit according to an embodiment of this application.

For example, the integrated circuit 200 shown in FIG. 8 is used as an example. If the first feed line 205 includes the first vertical feed line and the first horizontal feed line, and the second feed line 206 includes the second vertical feed line and the second horizontal feed line, a top view of the integrated circuit 200 may be shown in FIG. 9. In FIG. 9, to illustrate locations of the two feed points on the first radiation patch 202 and the two feed points on the second radiation patch 203, a coordinate system is established for the illustration. If the center of the second radiation patch 203 (or the center of the first radiation patch 202) is used as an origin, a horizontal direction of the first radiation patch 202 is used as a horizontal axis, and a vertical direction of the second radiation patch 203 is used as a vertical axis, the coordinate system of a plane on which the top view is located is established. The first horizontal feed line, the first vertical feed line, the second horizontal feed line and the second vertical feed line are located on a −x axis, a −y axis, a +x axis, and a +y axis of the coordinate system respectively.

It can be seen from FIG. 9 that if the second feed line 206 includes the second vertical feed line and the second horizontal feed line, and the integrated circuit 200 further includes the plurality of metal columns, both the second vertical feed line and the second horizontal feed line may be located in the encirclement formed by the plurality of metal columns. In this way, both the second vertical feed line and the second horizontal feed line are located in the potential zero-point region of the first radiation patch 202. This improves isolation between the second frequency band signal and the first frequency band signal in two polarization directions, and further improves, to some extent, the isolation between a second frequency band signal in a horizontal polarization direction and a second frequency band signal in a vertical polarization direction.

Similar to connection manners of the first feed line 205, the second feed line 206, and the radio frequency processing chip 204, when the first feed line 205 includes the first vertical feed line and the first horizontal feed line, and the second feed line 206 includes the second vertical feed line and the second horizontal feed line, the first vertical feed line, the first horizontal feed line, the second vertical feed line, and the second horizontal feed line each may be connected to an internal circuit (for example, the first radio frequency line and the second radio frequency line) of the radio frequency processing chip 204 by using four solder bumps (solder bump). A joint between the first vertical feed line and a solder bump may be referred to as a first vertical feed point or a first vertical feedpoint. A joint between the first horizontal feed line and a solder bump may be referred to as a first horizontal feed point or a first horizontal feedpoint. A joint between the second vertical feed line and a solder bump may be referred to as a second vertical feed point or a second vertical feedpoint. A joint between the second horizontal feed line and a solder bump may be referred to as a second horizontal feed point or a second horizontal feedpoint.

The dual-polarized antenna has a characteristic of dual-channel communication at a same frequency band. Therefore, a duplex operation can be implemented by using the dual-polarized antenna, to improve a communication capacity, improve system sensitivity, and enhance an anti-multipath effect of a system.

In addition, to further improve isolation between a first frequency band signal transmitted on the first vertical feed line and a first frequency band signal transmitted on the first horizontal feed line, a first groove may be further disposed on the first radiation patch 202. The first vertical feed line and the first horizontal feed line are located on two sides of the first groove respectively.

In this embodiment of this application, neither a shape nor a size of the first groove is specifically limited, provided that the first groove can be configured to isolate the two feed points on the first radiation patch. For example, the first groove may be a T-shaped groove. A vertical part of the first groove may be perpendicular to a connection line between a first vertical polarization feed point and a first horizontal polarization feed point.

The first groove may isolate, to some extent, the first frequency band signal transmitted on the first vertical feed line and the first frequency band signal transmitted on the first horizontal feed line, to achieve an effect of improving the isolation between the first frequency band signals in the two polarization directions. Therefore, to achieve isolation effects of different degrees, width, a length, and the like of the first groove may be adjusted correspondingly.

Figure 10:
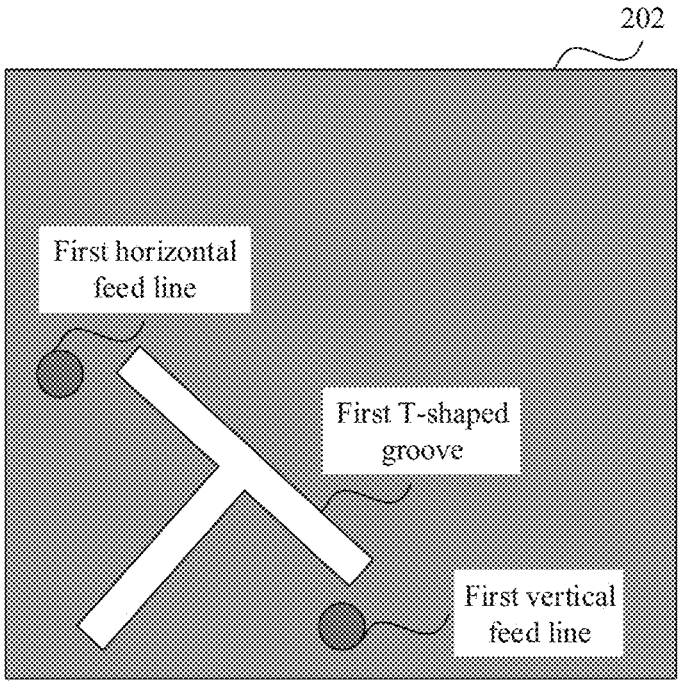
FIG. 10 is a schematic diagram of a structure of a first radiation patch according to an embodiment of this application.
Figure 11:
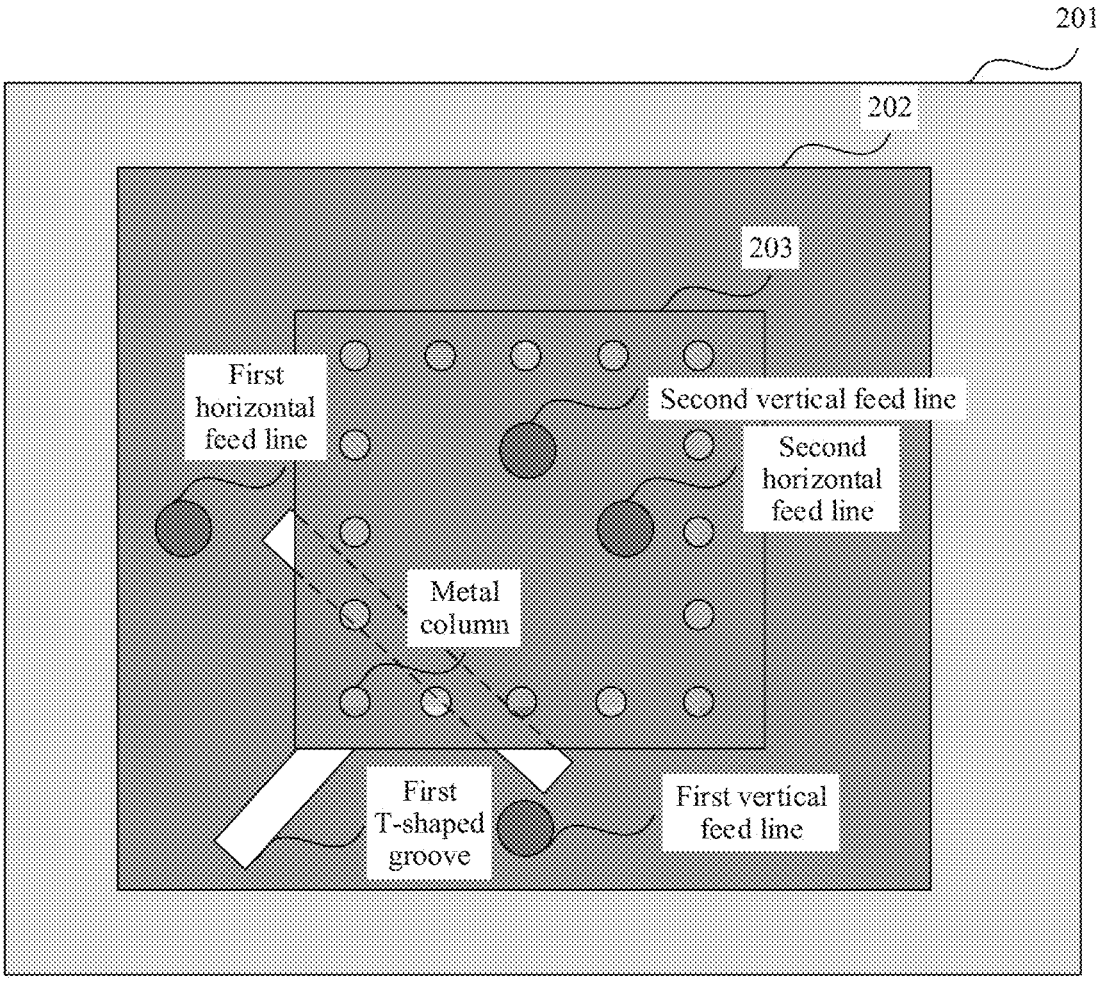
FIG. 11 is a schematic diagram of a structure of an eighth integrated circuit according to an embodiment of this application.

After the T-shaped first groove is disposed on the first radiation patch 202, a structure of the first radiation patch 202 may be shown in FIG. 10. The integrated circuit 200 shown in FIG. 9 is used as an example. After the first T-shaped groove is disposed on the first radiation patch 202, the integrated circuit 200 in FIG. 9 may be shown in FIG. 11.

Likewise, to further improve isolation between second frequency band signals in the two polarization directions, a second groove may be disposed on the second radiation patch. The second vertical feed line and the second horizontal feed line are located on two sides of the second groove respectively. For an implementation of the second groove, refer to related descriptions of the first groove. Details are not described herein again.

In conclusion, in the integrated circuit 200 provided in this embodiment of this application, the first radiation patch 202 and the second radiation patch 203 are placed on the different layers of the bearer structure 201, and may be configured respectively to receive/send different frequency band (namely, the first frequency band and the second frequency band below) signals. Therefore, the integrated circuit 200 can implement the dual-band operation.

In addition, in the integrated circuit 200, the first radiation patch 202 and the second radiation patch 203 are fed separately by using different feed lines (namely, the first feed line 205 and the second feed line 206). Therefore, a coupling degree between the first radiation patch 202 and the second radiation patch 203 is relatively low. A frequency range of the first frequency band corresponding to the first radiation patch 202 and a frequency range of the second frequency band corresponding to the second radiation patch 203 may be separately adjustable. For example, the first frequency band may be adjusted by adjusting the first size, and the second frequency band may be adjusted by adjusting the second size. For another example, when the coupled feeding manner is used, the first frequency band may be adjusted by adjusting a coupling degree between the first radiation patch 202 and the first feed line 205, and the second frequency band may be adjusted by adjusting a coupling degree between the second radiation patch 203 and the second feed line 206. Therefore, the integrated circuit 200 has higher design flexibility, and the two frequency bands have higher tunable degrees, and this can meet different use requirements.

In addition, in this embodiment of this application, a tunable capacitor or a switch may be disposed on the second radiation patch 203 to attune the second frequency band (to be specific, the frequency range of the second frequency band is adjusted). The second radiation patch 203 is divided into two parts (referred to as a first part and a second part below). The first part is connected to the second part by using the tunable capacitor or the switch. A capacitance value of the tunable capacitor or a connection/disconnection state of the switch is adjusted to attune the second frequency band.

According to the integrated circuit 200 provided in this embodiment of this application, the coupling degree between the first frequency band and the second frequency band is relatively low. Therefore, when the second frequency band is tuned in the foregoing manner, impact on the first frequency band is relatively small.

Figure 12:
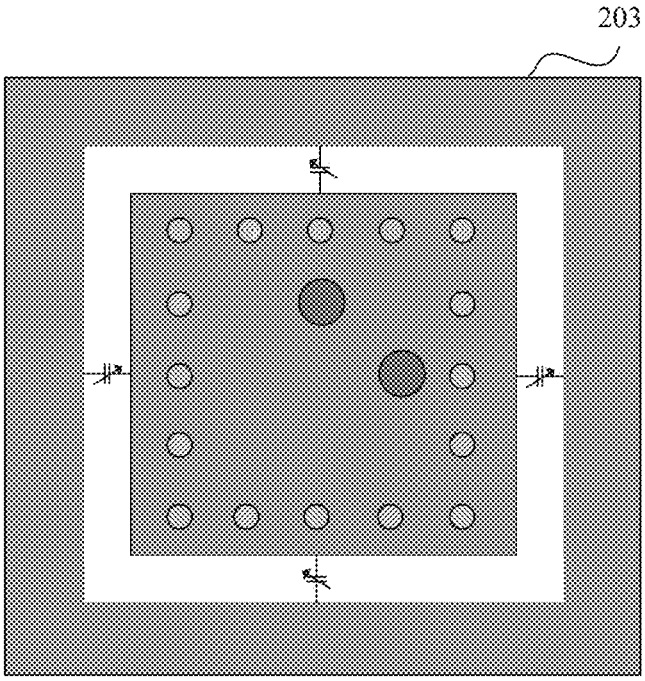
FIG. 12 is a schematic diagram of a structure of a second radiation patch according to an embodiment of this application.

For example, as shown in FIG. 12, the second radiation patch 203 is divided into the two parts. The first part is connected to the second part by using four tunable capacitors. Capacitance values of the four tunable capacitors are adjusted to attune the second frequency band.

Likewise, a tunable capacitor or a switch may be disposed on the first radiation patch 202 to attune the first frequency band. A specific manner is similar to the foregoing manner of attuning the second frequency band, and details are not described herein again.

In addition, the integrated circuit 200 shown in FIG. 2 may be further fastened to a printed circuit board (printed circuit board, PCB). The bearer structure 201 is connected to the PCB by using a ball grid array (ball grid array, BGA).

Figure 13:
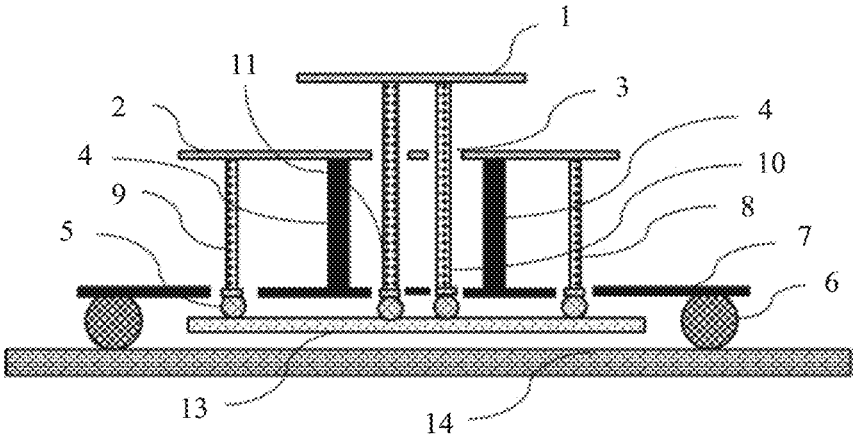
FIG. 13 is a schematic diagram of a structure of an electronic device according to an embodiment of this application.
Figure 13:
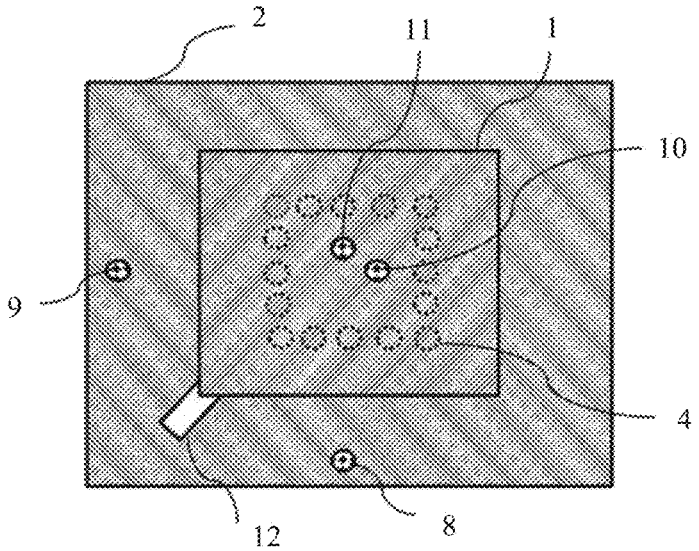

Based on a same inventive concept, an embodiment of this application further provides an electronic apparatus equipped with an antenna in package integrated circuit. Referring to FIG. 13, the electronic apparatus includes an upper-layer radiation patch 1, a lower-layer radiation patch 2, a lower-layer radiation patch window 3, a metalized connection hole 4, a solder bump (solder hump) 5, and a solder ball (solder ball) (which may also be referred to as a BGA ball) 6, a reference ground 7, a low-frequency vertical polarization feed point 8, a low-frequency-horizontal polarization feed point 9, a high-frequency horizontal polarization feed point 10, a high-frequency vertical polarization feed point 11, a radio frequency processing chip 13, and a printed circuit board (printed circuit board, PCB) 14.

The upper-layer radiation patch 1 has a first size corresponding to a high-frequency band (for example, a 39 GHz frequency band), and the lower-layer radiation patch 2 has a second size corresponding to a low-frequency band (for example, a 28 GHz frequency band). The upper-layer radiation patch 1 is directly fed by using the high-frequency horizontal polarization feed point 10 and the high-frequency vertical polarization feed point 11 that pass through the lower-layer radiation patch window 3. The lower-layer radiation patch 2 is directly fed by using the low-frequency vertical polarization feed point 8 and the low-frequency horizontal polarization feed point 9. One end of the metalized connection hole 4 is connected to the reference ground, and the other end of the metalized connection hole 4 is connected to the lower-layer radiation patch 2. A plurality of metalized connection holes 4 form square encirclement around a center of the upper-radiation patch 1. Both the high-frequency horizontal polarization feed point 10 and the high-frequency vertical polarization feed point 11 are located in the encirclement. The low-frequency vertical polarization feed point 8, the low-frequency horizontal polarization feed point 9, the high-frequency horizontal polarization feed point 10, and the high-frequency vertical polarization feed point 11 each are connected to the radio frequency processing chip 13 by using four solder bumps 5. The reference ground 7 is connected to the PCB board by using the solder ball 6.

The electronic apparatus shown in FIG. 13 further includes a T-shaped groove 12 disposed on the lower-layer radiation patch 2. The low-frequency vertical polarization feed point 8 and the low-frequency horizontal polarization feed point 9 are located on two sides of the T-shaped groove 12 respectively. The T-shaped groove 12 may be configured to improve isolation between a low-frequency band signal transmitted on the low-frequency vertical polarization feed point 8 and a low-frequency band signal transmitted on the low-frequency horizontal polarization feed point 9.

It should be noted that in the electronic apparatus shown in FIG. 13, a bearer structure for bearing the upper-layer radiation patch 1 and the lower-layer radiation patch 2 is not specifically limited, and the bearer structure is not shown in FIG. 13.

In the electronic apparatus shown in FIG. 13, the upper-layer radiation patch 1 may be considered as a specific example of the foregoing second radiation patch 203. The lower-layer radiation patch 2 may be considered as a specific example of the foregoing first radiation patch 202. The metalized connection hole 4 may be considered as a specific example of the foregoing metal column. The reference ground 7 may be considered as a specific example of the foregoing ground plane. The low-frequency vertical polarization feed point 8 may be considered as a specific example of the foregoing first vertical feed line. The low-frequency horizontal polarization feed point 9 may be considered as a specific example of the foregoing first horizontal feed line. The high-frequency horizontal polarization feed point 10 may be considered as a specific example of the foregoing second horizontal feed line. The high-frequency vertical polarization feed point 11 may be considered as a specific example of the foregoing second vertical feed line. The T-shaped groove 12 may be considered as a specific example of the foregoing first T-shaped groove.

It should be noted that a part of the electronic apparatus shown in FIG. 13 except the BGA ball and the PCB may be considered as a specific example of the foregoing integrated circuit 200. For an implementation and a technical effect that are not described in detail in the electronic apparatus shown in FIG. 13, refer to related descriptions in the integrated circuit 200.

The following provides some simulation results of the electronic apparatus shown in FIG. 13.

Figure 14:
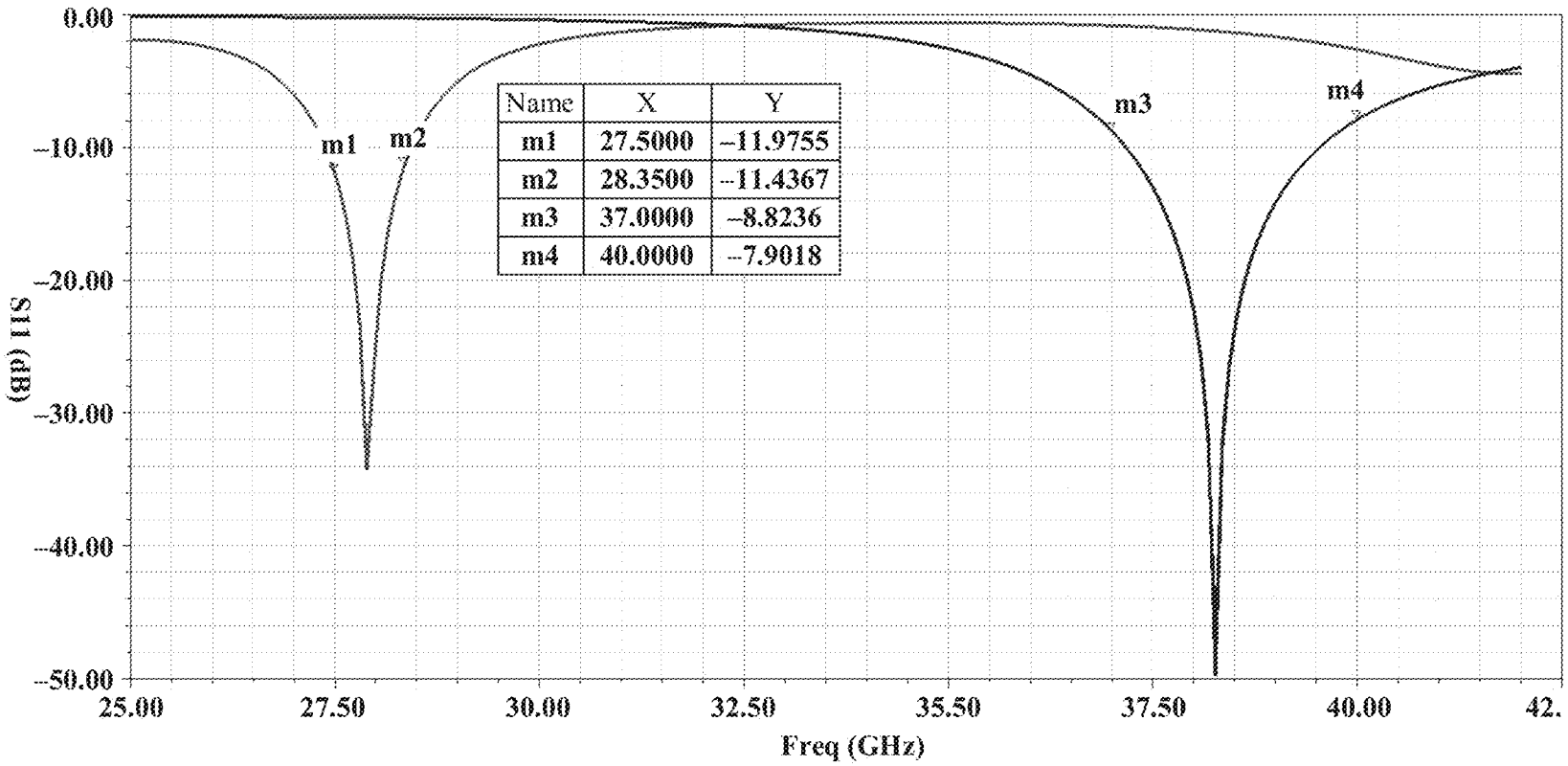
FIG. 14 is a schematic diagram of a simulation result of a return loss of an electronic device according to an embodiment of this application.

FIG. 14 is an emulation result of a return loss of the electronic apparatus shown in FIG. 13. A horizontal coordinate represents a frequency (unit: GHz). A vertical coordinate represents a return loss value (unit: dB). It can be seen from FIG. 14 that, return losses of the electronic apparatus shown in FIG. 13 at a lowest frequency point (m3) and a highest frequency point (m4) in the high-frequency band (the 39 GHz frequency band) are about −10 dB. Return losses at a lowest frequency point (m1) and a highest frequency point (m2) in the low-frequency band (the 28 GHz frequency band) are also about −10 dB. Therefore, signal losses are low in both the high-frequency band and the low-frequency band, and the electronic apparatus well covers two frequency bands; the high-frequency band and the low-frequency band.

Figure 15:
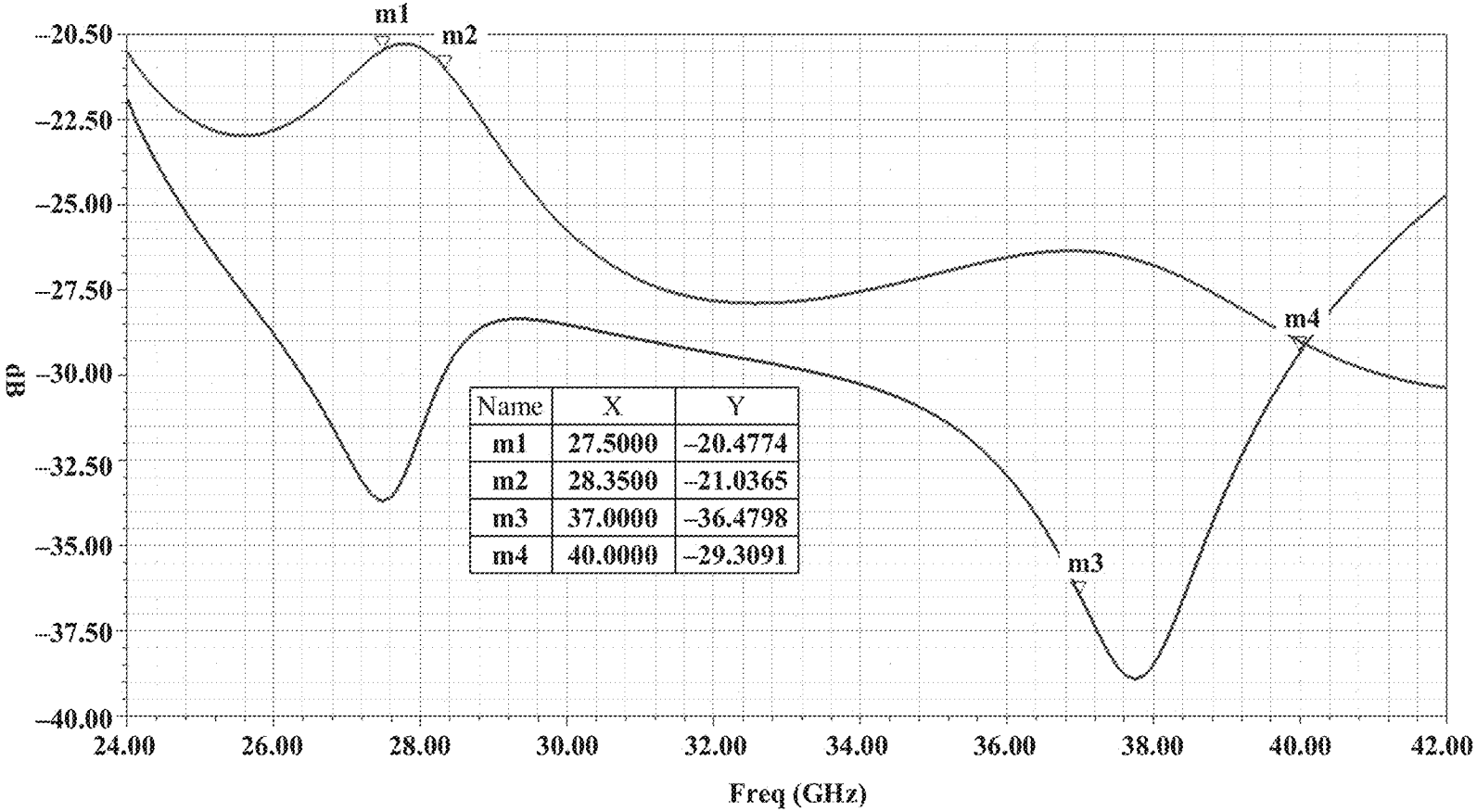
FIG. 15 is a schematic diagram of a simulation result of isolation between a high-frequency band and a low-frequency band of an electronic device according to an embodiment of this application.
Figure 16:
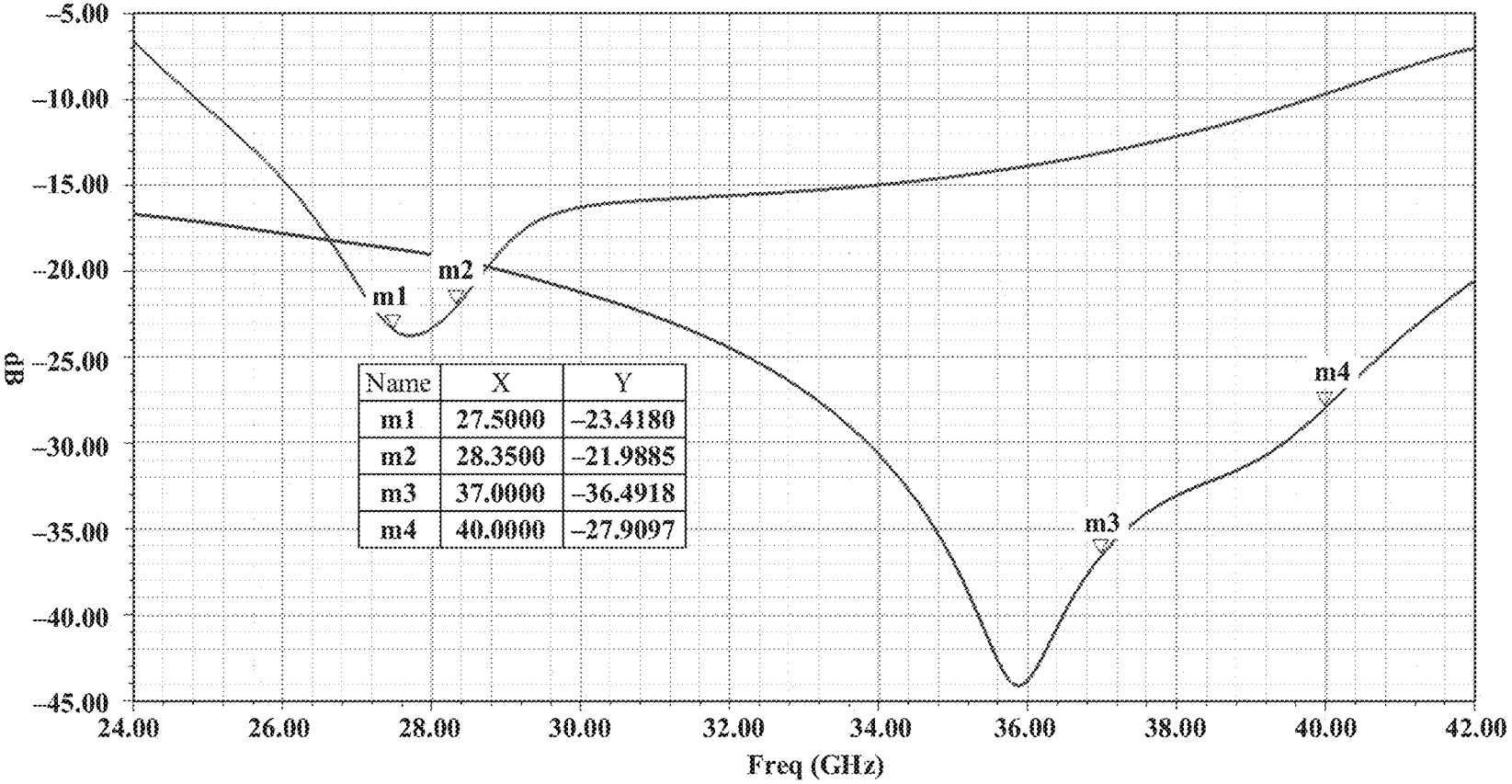
FIG. 16 is a schematic diagram of a simulation result of isolation between signals in two polarization directions in an electronic device according to an embodiment of this application.

FIG. 15 is an emulation result of isolation between the high-frequency band and the low-frequency band of the electronic apparatus shown in FIG. 13. A horizontal coordinate represents a frequency, (unit: GHz). A vertical coordinate represents isolation (unit: dB). A curve including m1 and m2 represents isolation between a high-frequency vertical polarization direction and a low-frequency horizontal polarization direction. A curve including m3 and m4 represents isolation between a high-frequency horizontal polarization direction and a low-frequency vertical polarization direction. It can be seen from the two curves in FIG. 15 that isolation between a high-frequency signal and a low-frequency signal is higher than −20 dB. Isolation between the two frequency bands is relatively high, and mutual impact between the two frequency bands is relatively small. FIG. 16 is an emulation result of isolation of signals in two polarization directions in the electronic apparatus shown in FIG. 13. A horizontal coordinate represents a frequency (unit: GHz). A vertical coordinate represents isolation (unit: dB). A lowest frequency point of the low-frequency band is m1, and a highest frequency point of the low-frequency band is m2. A lowest frequency point of the high-frequency band is m3, and a highest frequency point of the high-frequency band is m4. It can be seen from FIG. 16, that in the low-frequency band, isolation of low-frequency signals in two polarization directions is higher than −20 dB. In the high-frequency band, isolation of high-frequency signals in two polarization directions is higher than −40 dB. The isolation between signals in the two polarization directions is high, regardless of whether the signals are in the high-frequency band or the low-frequency band.

Figure 17:
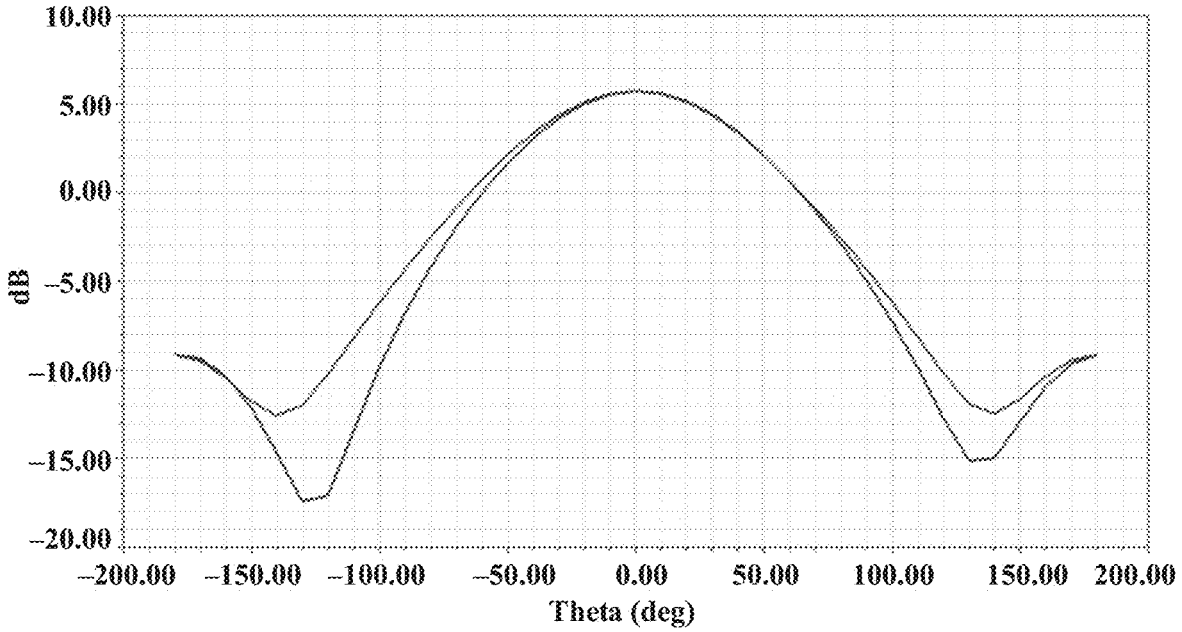
FIG. 17 is a schematic diagram of simulation results of a high-frequency gain and a low-frequency gain of an electronic device according to an embodiment of this application.
Figure 17:
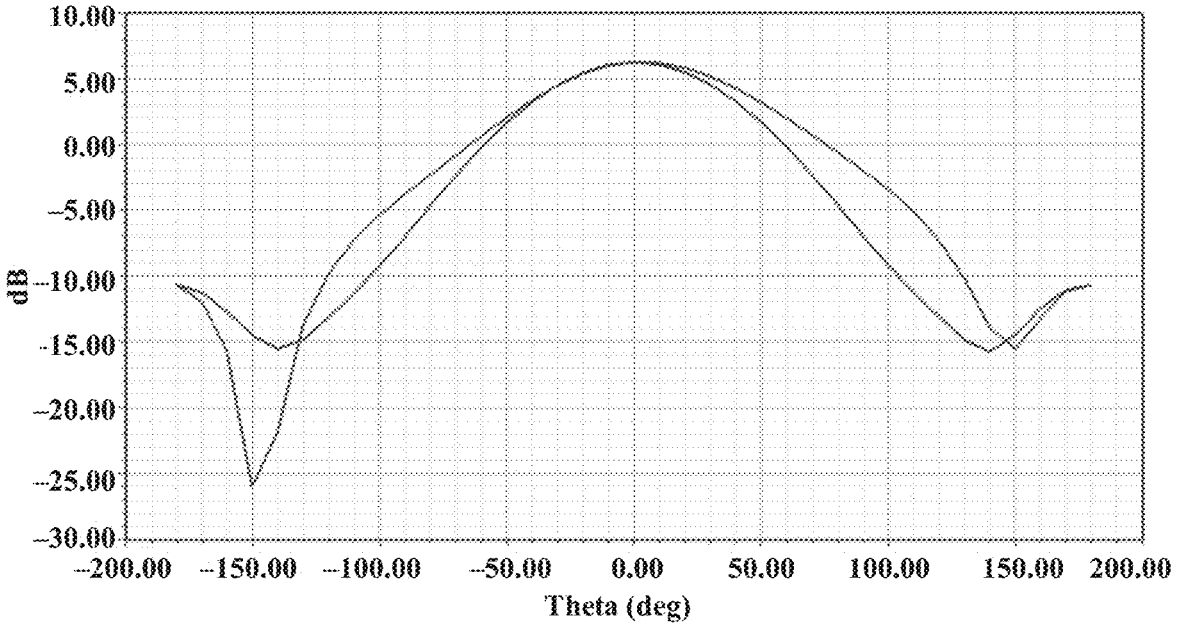

FIG. 17 is emulation results of a high-frequency gain and a low-frequency gain of the electronic apparatus shown in FIG. 13. A horizontal coordinate represents a frequency (unit: GHz). A vertical coordinate represents a gain (unit: dB). As shown in FIG. 17, high-frequency gains in the two polarization directions are ideal, and no obvious offset occurs in a direction pattern. Low-frequency gains in the two polarization directions are ideal, and no obvious offset occurs in a direction pattern. Therefore, the electronic apparatus shown in FIG. 13 can obtain the relatively ideal low-frequency gain and high-frequency gain.

Figure 18:
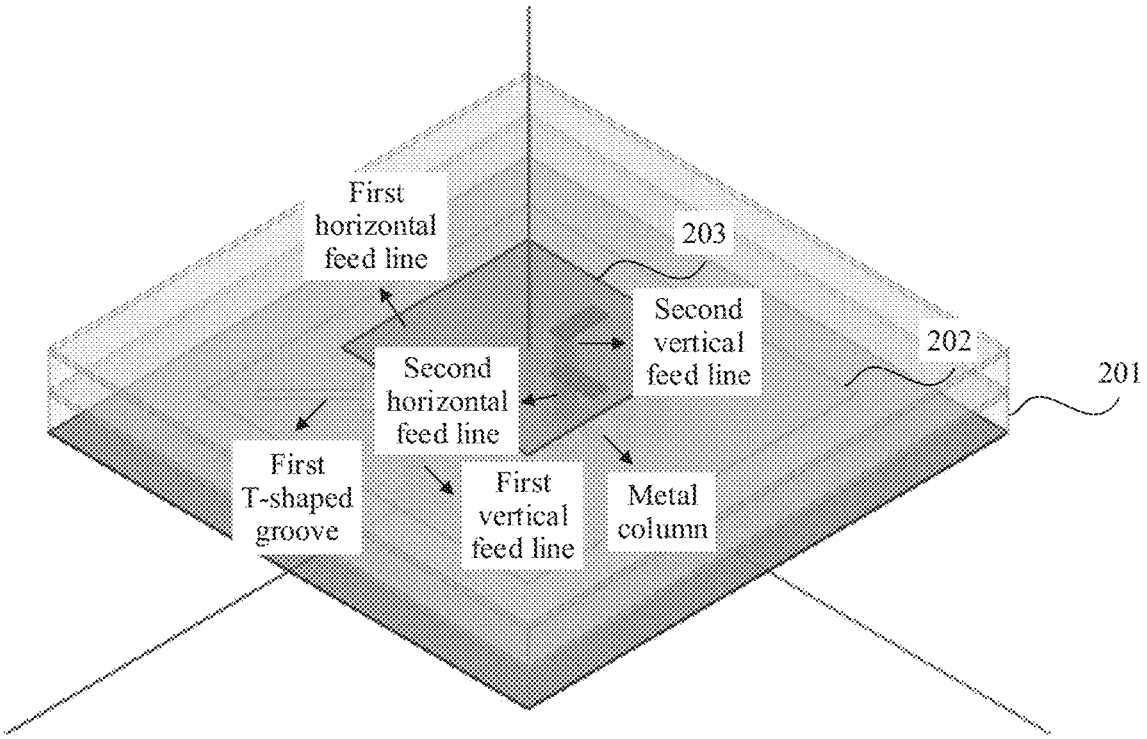
FIG. 18 is a schematic diagram of a structure of a ninth integrated circuit according to an embodiment of this application.

In addition, to more vividly illustrate the integrated circuit 200 provided in the embodiments of this application, the following provides a specific example of a 3D simulation model of the integrated circuit 200. Referring to FIG. 18, in the integrated circuit, the first radiation patch 202 borne by the bearer structure 201 has a first size corresponding, to the first frequency band signal. The second radiation patch 203 borne by the bearer structure 201 has a second size corresponding to the second frequency band signal. The first radiation patch 202 is directly fed by using the first vertical feed line and the first horizontal feed line. The second radiation patch 203 is fed by coupling the second vertical feed line and the second horizontal feed line. One end of the metal column is connected to the ground plane, and the other end of the metal column is connected to the first radiation patch 202. The plurality of metal columns form the square encirclement around the center of the second radiation patch 203. Both the first vertical feed line and the first horizontal feed line are located in the encirclement. In addition, in the integrated circuit, the first radiation patch 202 further includes the first T-shaped groove.

Based on the foregoing embodiments, an embodiment of this application further provides a terminal device. The terminal device includes the integrated circuit 200.

Optionally, the terminal device may further include a PCB, and the PCB is connected to the bearer structure 201 in the integrated circuit 200 by using a BGA.

For example, the terminal device includes but is not limited to a smartphone, a smartwatch, a tablet computer, a VR device, an AR device, a personal computer, a handheld computer, and a personal digital assistant.

Obviously, a person skilled in the art can make various modifications and variations to this application without departing from the spirit and scope of this application. This application is intended to cover these modifications and variations of this application provided that they fall within the scope of protection defined by the following claims and their equivalent technologies.

What is claimed is:

1. An integrated circuit in a terminal device, comprising:

a bearer structure;

a first radiation patch;

a second radiation patch; and a radio frequency processing chip, wherein the first radiation patch, the second radiation patch, and the radio frequency processing chip are placed on different layers of the bearer structure, a first feed line and a second feed line are disposed in the bearer structure, the radio frequency processing chip feeds the first radiation patch by using the first feed line, and the radio frequency processing chip feeds the second radiation patch by using the second feed line.

2. The integrated circuit according to claim 1, wherein a size of the first radiation patch is associated with a first frequency band signal, and a size of the second radiation patch is associated with a second frequency band signal.

3. The integrated circuit according to claim 2, wherein a first radio frequency line corresponding to the first frequency band signal and a second radio frequency line corresponding to the second frequency band signal are disposed in the radio frequency processing chip, the first feed line is connected to the first radio frequency line, and the second feed line is connected to the second radio frequency line.

4. The integrated circuit according to claim 3, wherein the first radiation patch is connected to the first radio frequency line by using the first feed line; and the second radiation patch is connected to the second radio frequency line by using the second feed line.

5. The integrated circuit according to claim 1, wherein the bearer structure comprises a first bearer structure that bears the first radiation patch, and a second bearer structure that bears the second radiation patch.

6. The integrated circuit according to claim 5, wherein the bearer structure further comprises:

a ground plane that comprises an opening, wherein the first feed line and the second feed line pass through the opening to feed the first radiation patch and the second radiation patch.

7. The integrated circuit according to claim 6, wherein the first radiation patch is located between the second radiation patch and the ground plane.

8. The integrated circuit according to claim 7, wherein a window is disposed on the first radiation patch, and the second feed line passes through the window to feed the second radiation patch.

9. The integrated circuit according to claim 7, further comprising:

a plurality of metal columns, wherein one end of each of the plurality of metal columns is connected to the ground plane, an other end of each of the plurality of metal columns is connected to the first radiation patch, the plurality of metal columns form an encirclement around the first radiation patch, and the second feed line passes through the encirclement.

10. The integrated circuit according to claim 9, wherein the first feed line is located outside the encirclement.

11. The integrated circuit according to claim 1, wherein the first feed line comprises a first vertical feed line and a first horizontal feed line, and the second feed line comprises a second vertical feed line and a second horizontal feed line.

12. The integrated circuit according to claim 11, wherein the first radiation patch comprises two feed points that correspond to the first vertical feed line and the first horizontal feed line respectively, and the second radiation patch comprises two feed points that correspond to the second vertical feed line and the second horizontal feed line respectively.

13. The integrated circuit according to claim 12, wherein a difference between polarization directions of the two feed points on the first radiation patch is 90°, a difference between polarization directions of the two feed points on the second radiation patch is 90°, and differences between polarization directions of a feed point of the two feed points on the first radiation patch and the two feed points on the second radiation patch are 90° and 180°.

14. The integrated circuit according to claim 11, wherein a first groove is disposed on the first radiation patch, and the first vertical feed line and the first horizontal feed line are located on two sides of the first groove respectively; and a second groove is disposed on the second radiation patch, and the second vertical feed line and the second horizontal feed line are located on two sides of the second groove respectively.

15. The integrated circuit according to claim 1, wherein the first radiation patch and the second radiation patch are parallel to each other, and a center of the first radiation patch is aligned with a center of the second radiation patch.

16. The integrated circuit according to claim 1, wherein the first radiation patch is divided into a first part and a second part that are connected by using a tunable capacitor or a switch unit.

17. The integrated circuit according to claim 1, wherein the second radiation patch is divided into a first part and a second part that are connected by using a tunable capacitor or a switch unit.

18. The integrated circuit according to claim 1, wherein the radio frequency processing chip is connected to the first feed line and the second feed line by using solder bumps.

19. The integrated circuit according to claim 1, wherein the bearer structure comprises at least one of:

one or more stacked dielectric layers, a dielectric layer and a metal layer that are alternately stacked, a dielectric layer and a metal ball structure that are alternately stacked, a dielectric layer and a metal column structure that are alternately stacked, or a plastic ball structure and a metal layer that are alternately stacked.

20. The integrated circuit according to claim 19, wherein a material of the dielectric layer comprises at least one of organic resin, polytetrafluoroethylene, or a polytetrafluoroethylene composite material comprising a fiberglass cloth; wherein a material of the metal layer comprises at least one of copper or tin; wherein a material of the metal column structure comprises at least one of copper or tin; and wherein a material of the metal ball structure includes at least one of copper or tin.

21. The integrated circuit according to claim 19, wherein the metal ball structure comprises a plurality of metal balls, the metal column structure comprises a plurality of metal columns, and the plastic ball structure comprises a plurality of plastic balls.

22. A terminal device, comprising an integrated circuit that comprises:

a bearer structure;

a first radiation patch;

a second radiation patch; and a radio frequency processing chip, wherein the first radiation patch, the second radiation patch, and the radio frequency processing chip are placed on different layers of the bearer structure, a first feed line and a second feed line are disposed in the bearer structure, the radio frequency processing chip feeds the first radiation patch by using the first feed line, and the radio frequency processing chip feeds the second radiation patch by using the second feed line.

23. The terminal device according to claim 22, further comprising:

a printed circuit board (PCB), wherein the PCB is connected to a bearer structure in the integrated circuit by using a ball grid array (BGA).

24. The terminal device according to claim 22, wherein the terminal device is a smartphone.

* * * * *